US011358162B2

(12) United States Patent
Duffin et al.

(10) Patent No.: US 11,358,162 B2
(45) Date of Patent: Jun. 14, 2022

(54) SPRINKLER HEAD WITH DAMPER MOTOR

(71) Applicants: Don Duffin, Paul, ID (US); Roger Duffin, Paul, ID (US)

(72) Inventors: Don Duffin, Paul, ID (US); Roger Duffin, Paul, ID (US)

(73) Assignee: XCAD VALVE AND IRRIGATION, INC, Paul, ID (US)

( * ) Notice: Subject to any disclaimer, the term of this patent is extended or adjusted under 35 U.S.C. 154(b) by 178 days.

(21) Appl. No.: 16/404,635

(22) Filed: May 6, 2019

(65) Prior Publication Data

US 2019/0336994 A1 Nov. 7, 2019

Related U.S. Application Data

(60) Provisional application No. 62/627,053, filed on May 4, 2018.

(51) Int. Cl.

| | |
|---|---|
| ***B05B 3/04*** | (2006.01) |
| ***B05B 3/02*** | (2006.01) |
| ***B05B 3/00*** | (2006.01) |

(52) U.S. Cl.

CPC ..... *B05B 3/0486* (2013.01); *B05B 3/008* (2013.01); *B05B 3/02* (2013.01); *B05B 3/04* (2013.01); *B05B 3/0468* (2013.01)

(58) Field of Classification Search

CPC .. B05B 3/02; B05B 3/04; B05B 3/003; B05B 3/005; B05B 3/007; B05B 3/008; B05B 3/4463; B05B 3/0463; B05B 3/0468; B05B 3/0486

See application file for complete search history.

(56) References Cited

U.S. PATENT DOCUMENTS

| | | | |
|---|---|---|---|
| 581,252 | A | 8/1897 | Quayle |
| 5,439,174 | A | 8/1995 | Sweet |
| 6,267,299 | B1 | 7/2001 | Meyer |
| 7,100,842 | B2 | 9/2006 | Meyer et al. |
| 8,584,969 | B2 | 11/2013 | Drechsel |
| 8,590,806 | B2 | 11/2013 | Drechsel |
| 8,991,724 | B2 | 3/2015 | Sesser et al. |
| 9,511,383 | B2 | 12/2016 | Drechsel |
| 10,239,066 | B2 * | 3/2019 | Sesser ..... B05B 3/0486 |
| 2017/0333924 | A1 | 11/2017 | Sesser et al. |

FOREIGN PATENT DOCUMENTS

| | | | |
|---|---|---|---|
| EP | 3248690 | A1 | 11/2017 |

* cited by examiner

*Primary Examiner* — Jason J Boeckmann

(74) *Attorney, Agent, or Firm* — Shaver & Swanson, LLP; Scott D. Swanson

(57) ABSTRACT

What is disclosed is a sprinkler head having a nozzle configured for spraying a fluid, such as irrigation water, at a distribution disk. The distribution disk is configured to rotate on an upper axle. The upper axle is housed within an upper axle housing. The upper axle housing is configured to rotate about a lower axle. The dual axle provides for two different rotation axles of the distribution disk in operation. Preferably a speed control device can be positioned to control the speed of rotation of one axle or both axles.

4 Claims, 12 Drawing Sheets

SPRINKLER HEAD WITH DAMPER MOTOR

PRIORITY/CROSS-REFERENCE TO RELATED APPLICATIONS

This application claims the benefit of U.S. Provisional Application No. 62/627,053, filed May 4, 2018, the disclosure of which is incorporated by reference.

TECHNICAL FIELD

The herein disclosed and claimed inventive concept(s) generally relates to a sprinkler head, and more particularly to a sprinkler head utilizing a distribution disc for randomizing fluid distribution.

BACKGROUND

Various sprinkler heads have been utilized to distribute irrigation water. What is needed is a sprinkler head that provides for increased functionality, including a more randomized distribution pattern, and control by proving a sprinkler head having a distribution disk utilizing two axes of rotation on two axles.

SUMMARY OF THE DISCLOSURE

Figure 1:
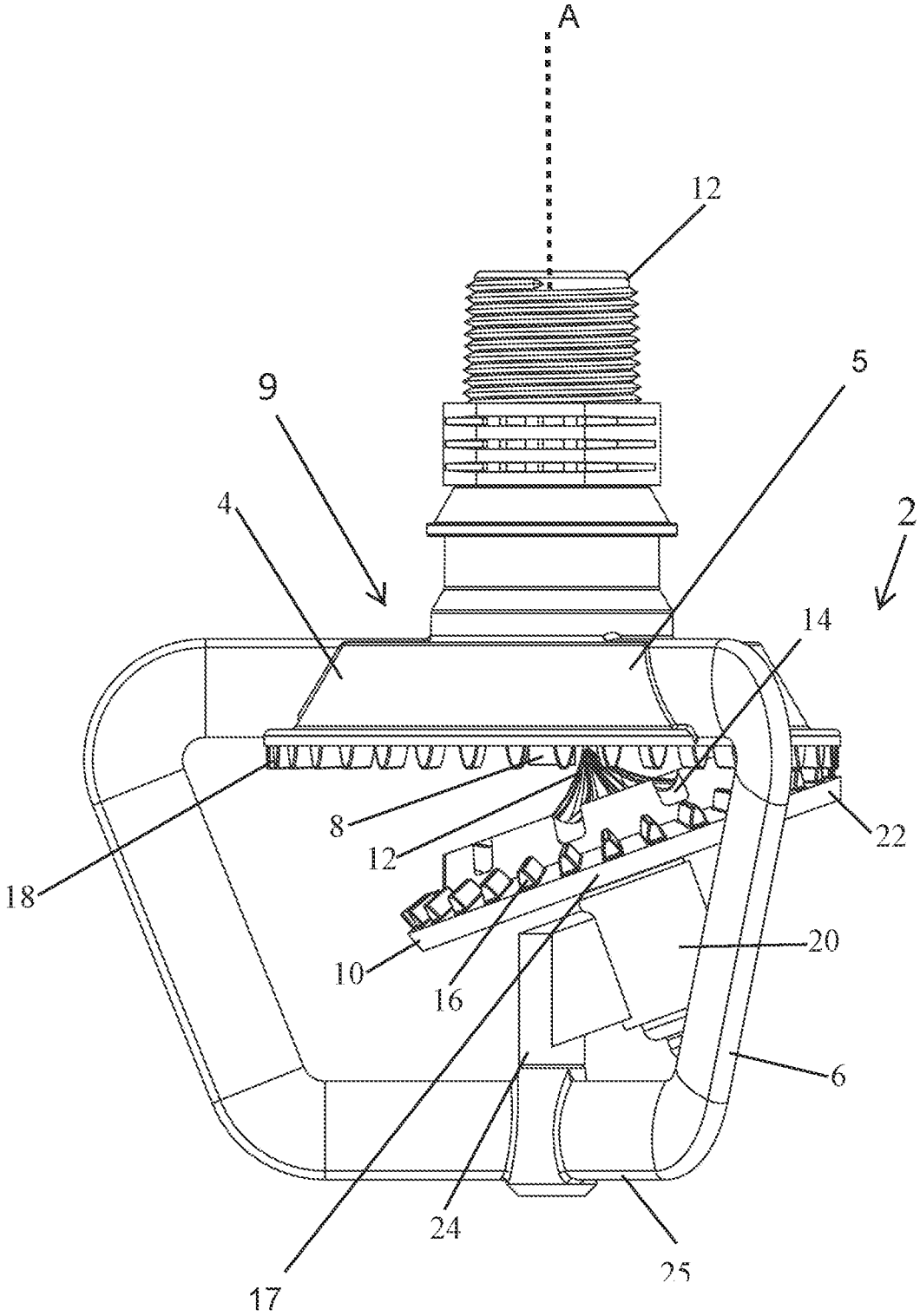
FIG. 1 is a side view of a first preferred embodiment of a sprinkler head.

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a sprinkler head having two axles for providing rotation of a distribution disk. The distribution disk is configured to distribute fluid, such as irrigation water, sprayed from a nozzle at the distribution disk. The sprinkler head utilizes dampeners on one axle or both axles to control the speed of rotation of that axle or of an element about that axle.

In a preferred embodiment the sprinkler head has a housing that has a fluid intake. A nozzle is positioned and configured to direct said fluid from the intake at a distribution disk. In a preferred embodiment the nozzle is positioned within a sprinkler disc of the sprinkler housing. The distribution disk is configured to rotate in response to fluid directed onto the distribution disk from the nozzle. In a preferred embodiment the distribution disk comprises a generally peaked surface having an apex, said surface incised by spirally radiating grooves. The distribution disk is attached to an upper axle. The distribution disk is configured to rotate with the upper axle. The upper axle is configured to rotate within an upper axle housing. A lower axle is attached to the upper axle housing. The upper axle housing is configured to rotate on the lower axle providing two axis of rotation of the distribution disk. The bushing can be integral with the distribution disk.

In a preferred embodiment the distribution disk has geared teeth configured to interact with geared teeth of the sprinkler housing to control rotation of the distribution disk. Preferably the geared teeth of the sprinkler housing are positioned on a sprinkler disk of the sprinkler housing. Alternatively the device is configured with a bushing configured to rotate with the distribution disk. The bushing has geared teeth positioned on or integral with the circumference of the bushing. The geared teeth are configured to interact with geared teeth on the sprinkler housing to control rotation of the distribution disk and bushing.

In an embodiment the upper axle and said lower axle are arranged in a parallel orientation. Alternatively the upper axle and lower axle can be oriented in a non-parallel orientation to provide a nutating rotation of the distribution disk. For example, the upper axle can be positioned at an angle relative to the lower axle to provide notational rotation. In a further embodiment the upper axle and lower axle can be configured to be oriented in the same plane during a portion of the rotation, for example if the upper axle housing is configured to rotate in a random orientation about the lower axle.

In a preferred embodiment at least one of the upper axle and the lower axle is configured with a speed control unit to slow the rotational speed in association with the axle. In a preferred embodiment the upper axle housing is configured to rotate on the lower axle to cause nutation of said distribution plate within said housing. In a further preferred embodiment the upper axle housing defines a circumference having a series of geared teeth projecting there from. The geared teeth are configured to interact with a series of geared teeth on an inner surface of said sprinkler housing.

In a preferred embodiment the sprinkler has a fluid delivery tube which extends through the sprinkler disk, and is directed at a distribution plate. In a preferred embodiment the sprinkler disk has on its periphery a number of projections which form gear teeth. Corresponding gear teeth on the distribution disk periphery engage the gear teeth on the sprinkler disk, and direct the path and speed of the rotation of the distribution disk.

In a preferred embodiment the distribution disk is set at a fixed angle so the gear teeth on the distribution plate and the gear teeth on the sprinkler disk engage as the distribution disk rotates around the lower axle. The lower axle is positioned within a housing that is supported by one or more support is which are attached to the sprinkler disk. The sprinkler disk and arms are commonly referred to herein as the sprinkler housing. In a preferred embodiment, an upper axle housing is set at an angle from the lower axle and secures the distribution disk. In a preferred embodiment the distribution disk is positioned at a non-horizontal angle such that the distribution disk both rotates and nutates in a fixed trajectory. In this embodiment the upper axle and lower axle are not parallel or coplanar. In an alternative preferred embodiment the distribution disk and upper axle are configured to provide rotation of the distribution disk without nutation. In this preferred embodiment the upper axle and lower axle are generally oriented in parallel. In a further preferred embodiment the upper axle housing and the lower axle can be configured such that the upper axle housing rotates about the lower axle to cause nutation of the distribution disk. As used herein when rotation is discussed about and axle, the axle can rotate with the object rotating, or the object rotation can rotate freely of the axle and not deviate from the scope of the invention.

In a preferred embodiment an axle extends from the distribution disk through a speed control hub. The speed control hub contains a viscous fluid which dampens the speed of rotation of the axle, and thus the speed of rotation of the distribution disk. The distribution disk has a raised center peak, which contains spiral grooves which guide water from the distribution disk. Water (or other fluid) is sprayed onto the distribution disk from the delivery tube and imparts a rotary force onto the distribution disk which causes the distribution disk to rotate. and/or nutate. Alternatively the speed control can be positioned within the upper axle housing such that the speed of rotation of the upper axle housing around its pivot axle (or pivot pin). In a further embodiment both the rotation of the upper axle housing as well as the nutation of the distribution disk can be controlled by speed control devices.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

While the presently disclosed technology is susceptible of various modifications and alternative constructions, certain illustrated embodiments thereof have been shown in the drawings and will be described below in detail. It should be understood, however, that there is no intention to limit the claimed technology to the specific form disclosed, but, on the contrary, the presently disclosed and claimed technology is to cover all modifications, alternative constructions, and equivalents falling within the spirit and scope of the inventive concept(s) as defined in the claims. The use of the term "upper" and "lower" refer to the orientation shown in the figures and are not to be construed as limiting in the event of rotation of a device. The term fluid is used generically herein to define a fluid flow of which can be distributed by a sprinkler head, including but not limited to irrigation water.

FIGS. 1 through 4 depict a first preferred embodiment of the inventive concepts disclosed herein. A sprinkler head 2 is depicted having an upper body 9 utilizing a sprinkler disc 4 formed in the shape of an annular ring 5 utilizing one or more support arms 6 configured to support a rotation arm and distribution disk. The sprinkler head is configured to attach to a source line such as by a threaded connector 12 configured for mating attachment to a source line. The sprinkler head is configured with a nozzle (not shown in FIG. 1) in connection with a distribution tube 8 that are configured to direct fluid spray, such as water, onto a distribution disk 10. The distribution disk is configured with an apex 12 and a series spirally radiating grooves 14 that are configured to distribute fluid sprayed on the distribution disk. The distribution disk is configured to rotate with the distribution disk support arm 24 as well as to rotate (or spin) independently of the distribution disk support arm via two axles 26, 28. The distribution disk support arm is connected at a first end 21 to the lower axle such that the second end 23 of the distribution disk support arm is configured to orbit around the lower axle. An upper axle 26 is attached to the distribution disk and housed within an upper axle housing 20. The upper axle housing can include a speed control unit 29 configured to damper the speed of rotation of the upper axle housing. A second or lower axle 28 is shown connecting the distribution disk support arm to the lower sprinkler support 25 of the sprinkler body arm 6. The lower sprinkler support can be a single arm 6 or can be comprised of multiple support arms as depicted in FIG. 1. The sprinkler head defines a fluid flow path A through an interior passage 30 in the sprinkler head, through the nozzle 7, and impinging upon the distribution disk 10.

Figure 2:
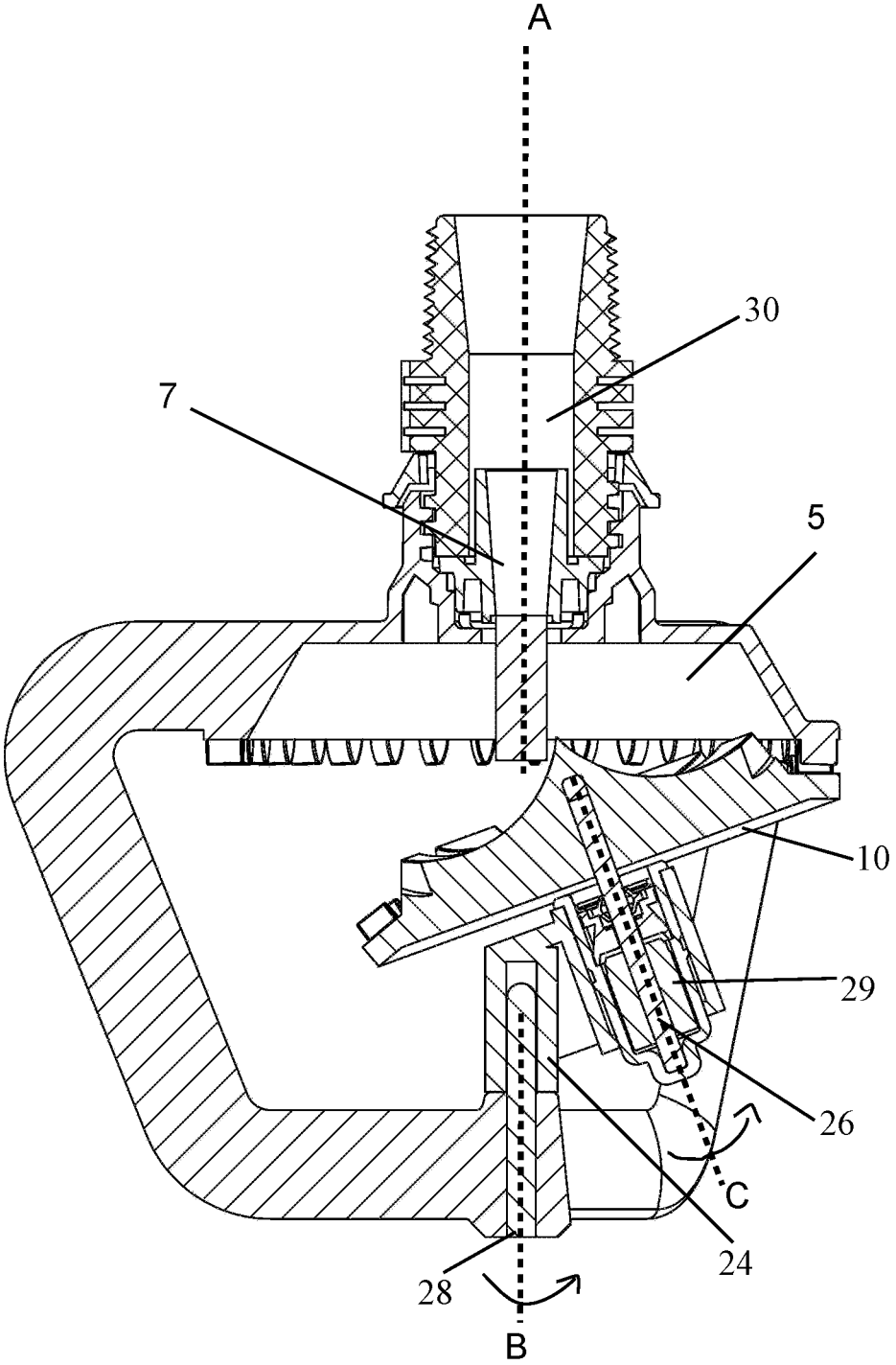
FIG. 2 is a cutaway view of a first preferred embodiment of a sprinkler head.
Figure 3:
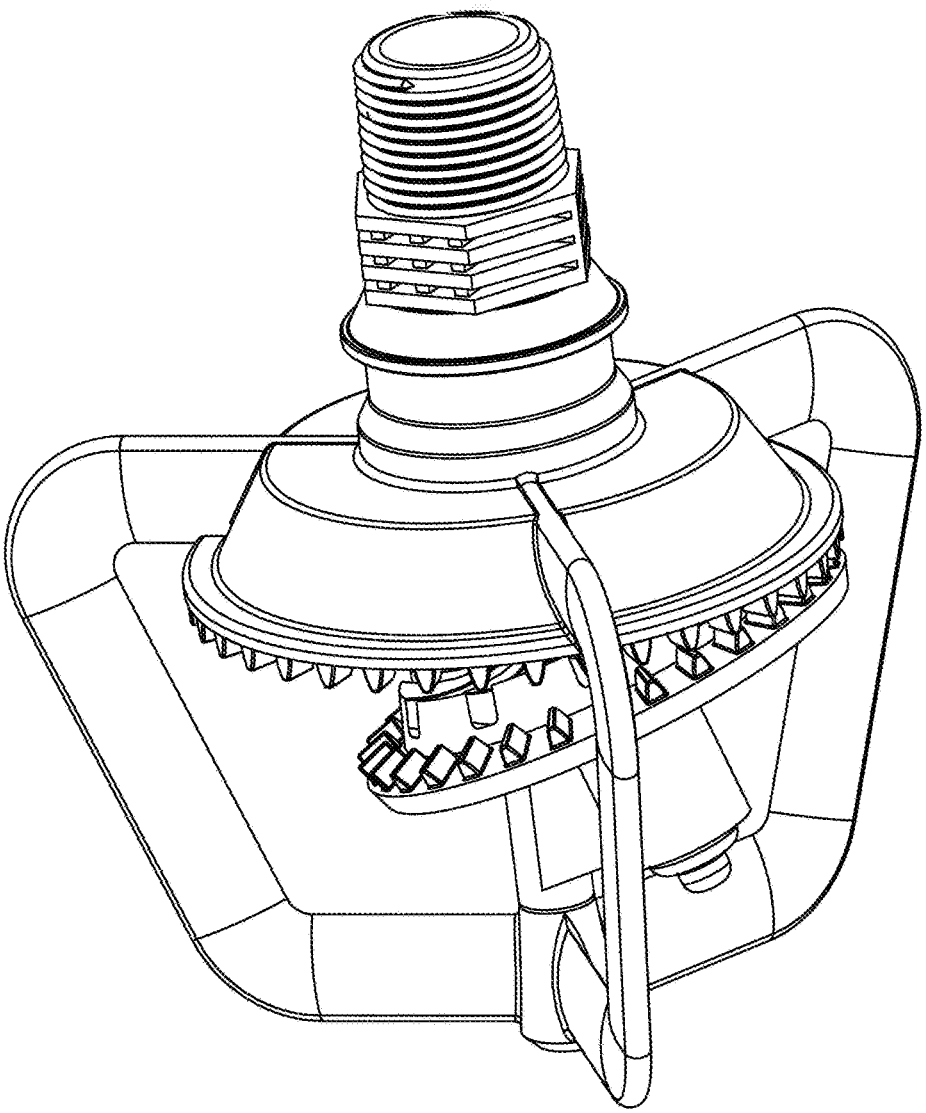
FIG. 3 is a perspective view of a first preferred embodiment of a sprinkler head.
Figure 4:
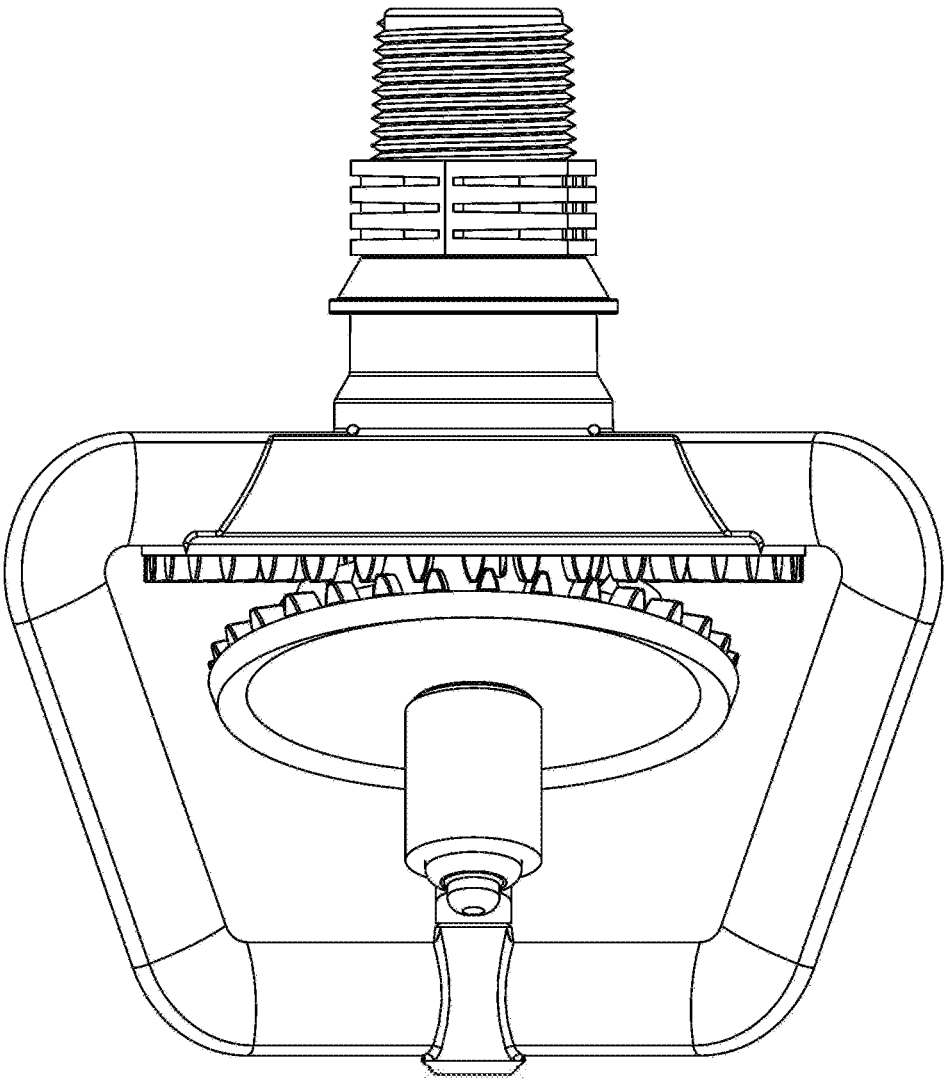
FIG. 4 is a side view of a first preferred embodiment of a sprinkler head.
Figure 5:
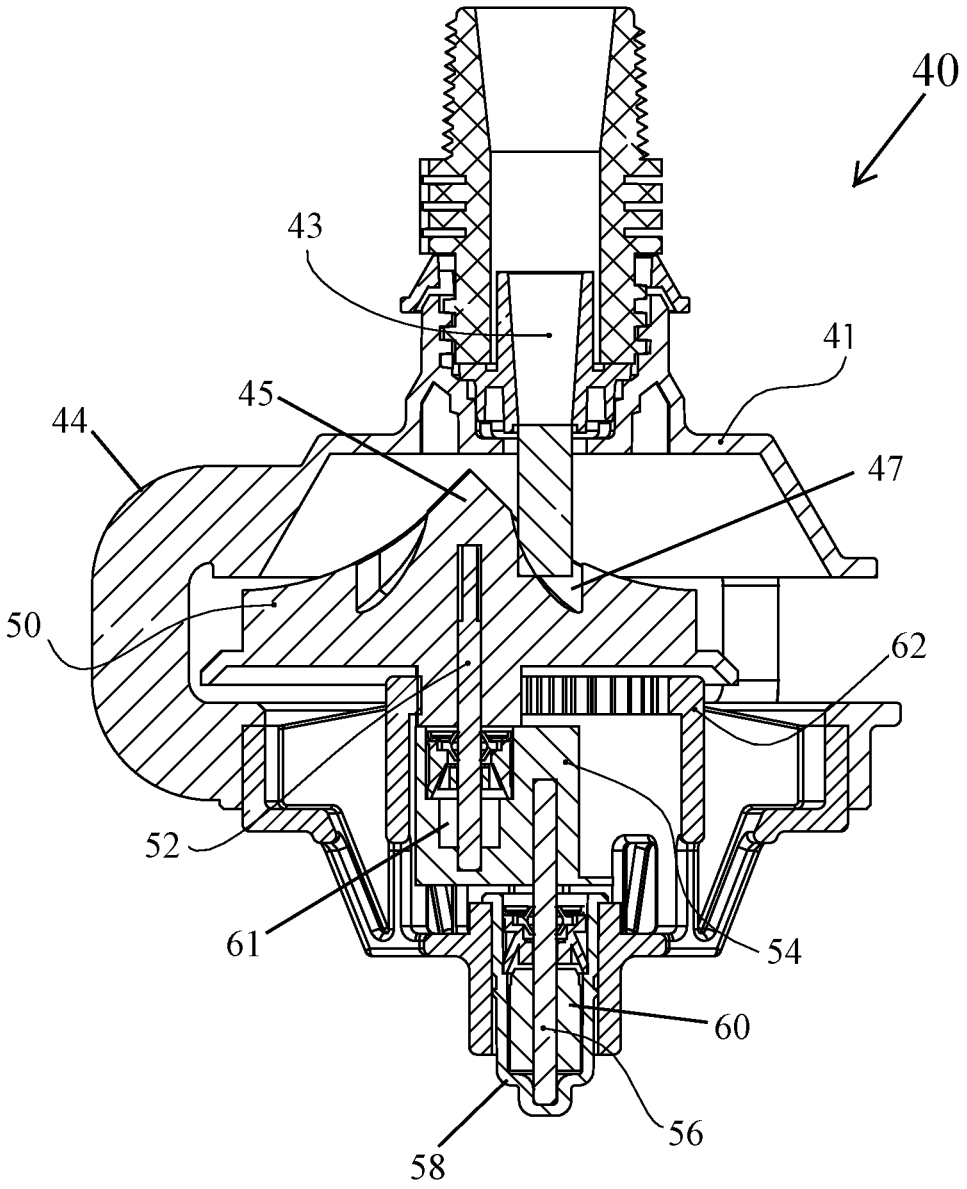
FIG. 5 is a cutaway view of a second preferred embodiment of a sprinkler head.
Figure 6:
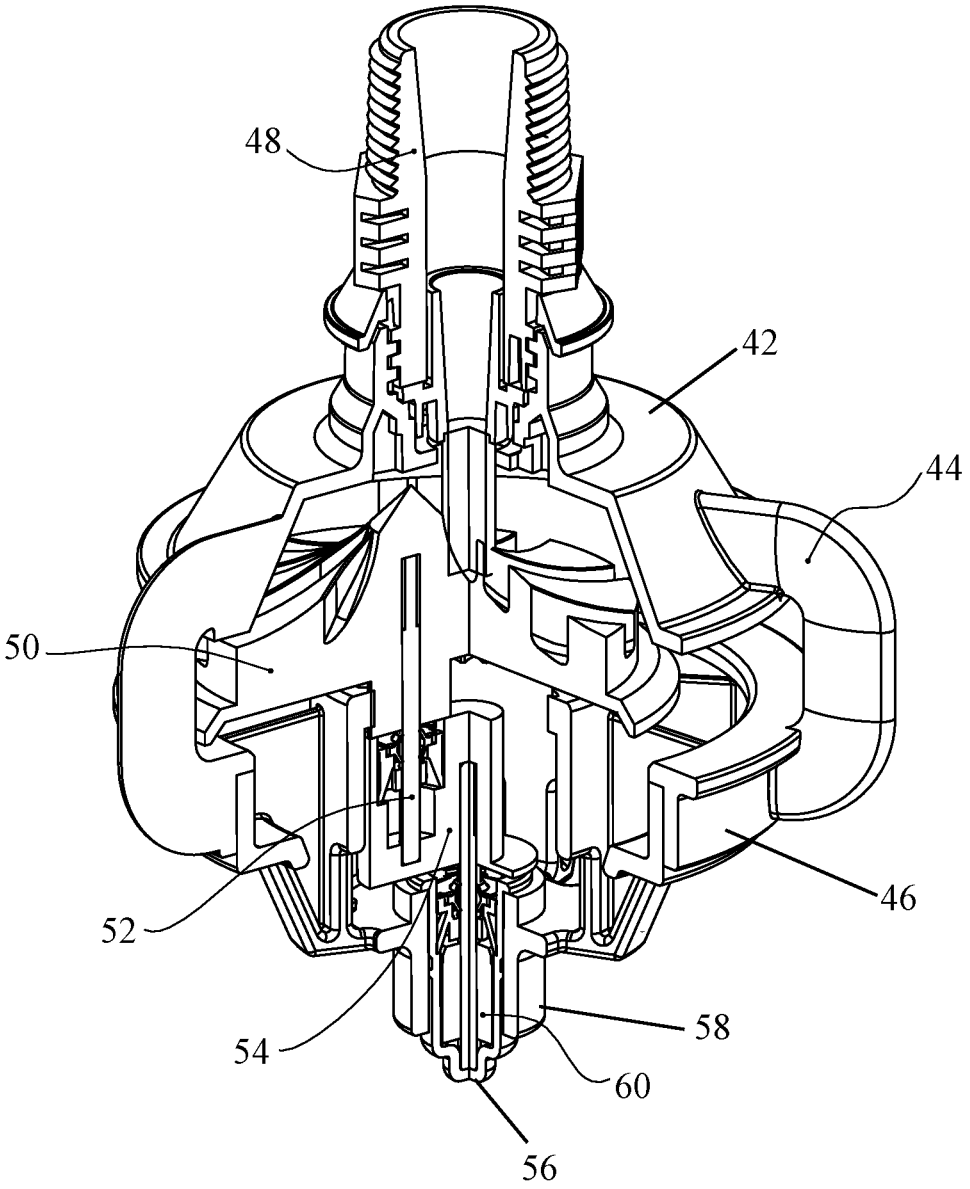
FIG. 6 is a partial cutaway perspective view of a second preferred embodiment of a sprinkler head.

In the embodiment depicted in FIGS. 1 through 4, the upper axle housing 20 is configured to rotate on the lower axle 28, as shown in FIG. 2. FIG. 2 further shows a distribution nozzle 7 within the flow tube 30 of the sprinkler body and configured for controlling the spray of water toward the distribution disk. The sprinkler head is configured such that when the upper axle housing and distribution disk rotate within the sprinkler head, geared teeth 16 positioned on the distribution disk are configured to engage with gear teeth 18 on the sprinkler disk to direct the path of rotation of the distribution plate at the uppermost portion 22 of the nutating disk. Preferably the geared teeth 16 are positioned on a beveled surface 17.

In a preferred embodiment either or both of the axles 26, 28 can utilize a speed control unit 30 such as a viscous or magnetic brake, to control the speed of rotation of either the distribution disk or the upper axle housing.

Figure 7A:
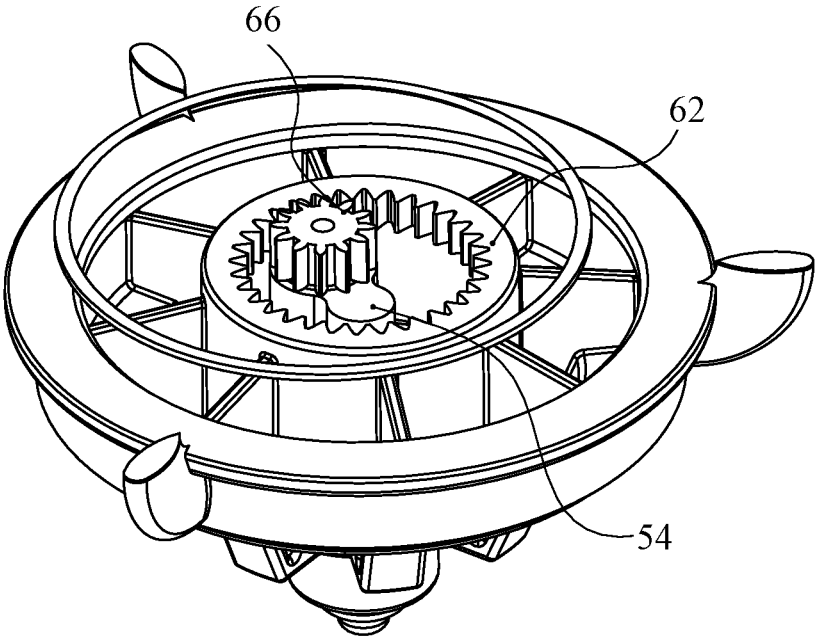
FIG. 7A is a cutaway perspective view of a second preferred embodiment of a sprinkler head.
Figure 7B:
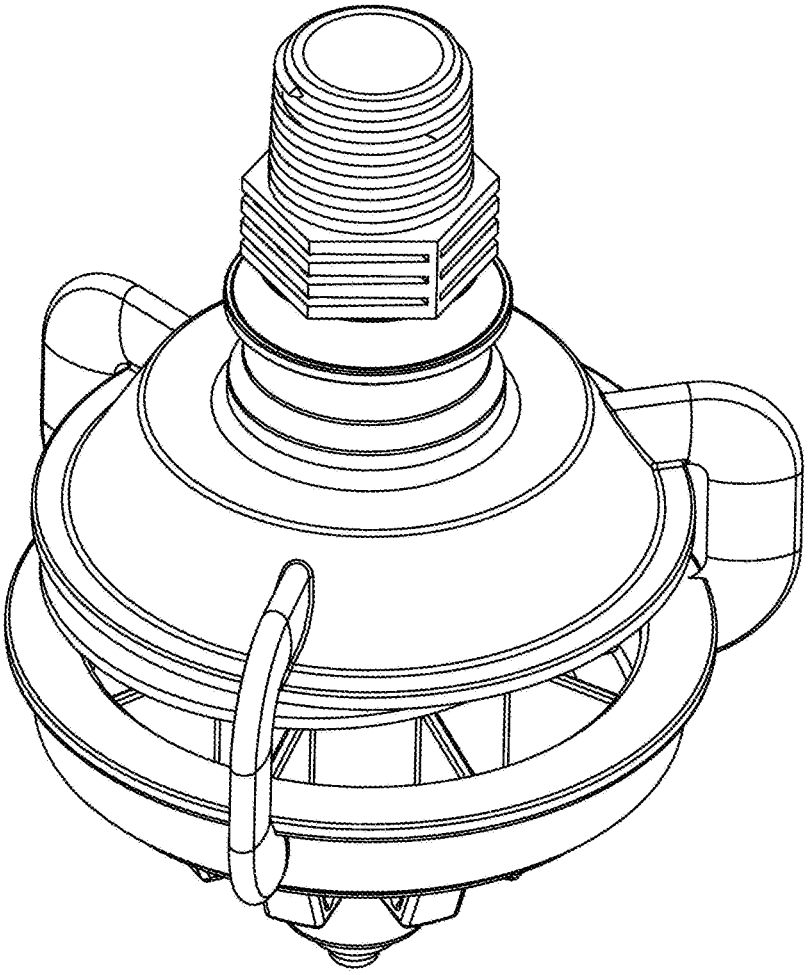
FIG. 7B is a perspective view of a second preferred embodiment of a sprinkler head as shown in FIG. 7A.
Figure 8:
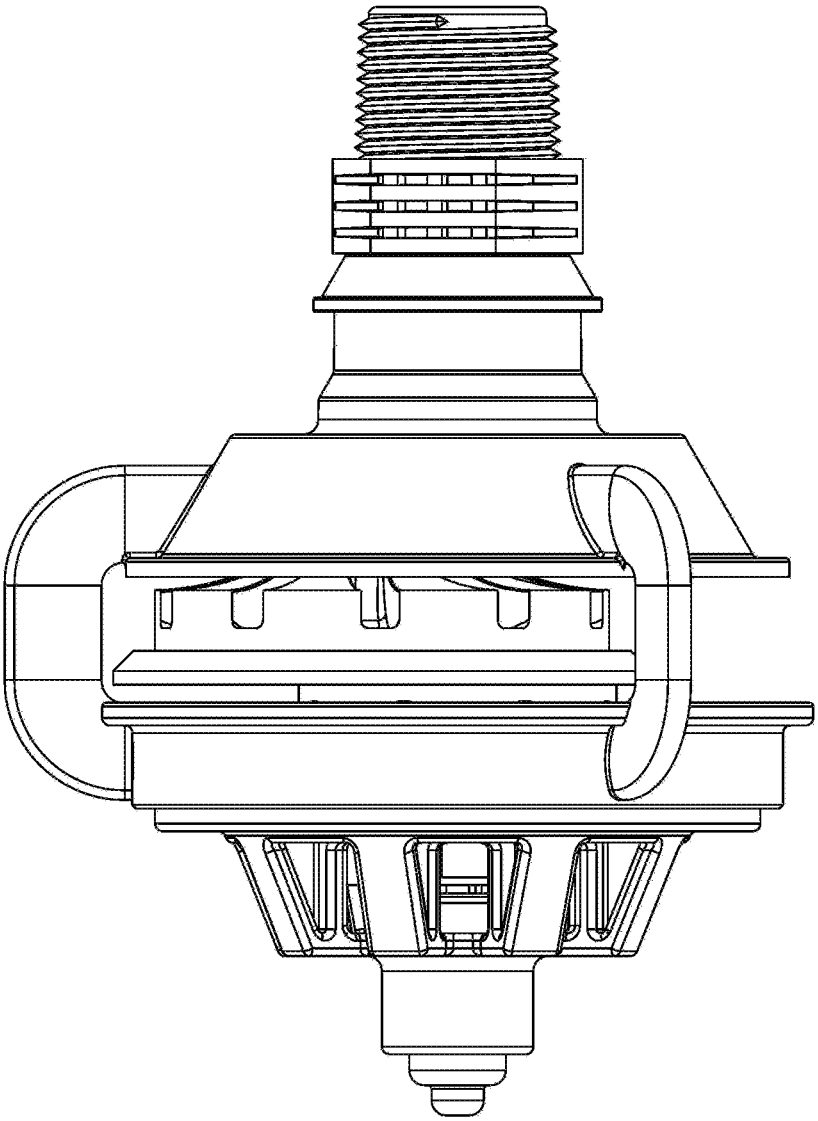
FIG. 8 is a side view of a second preferred embodiment of a sprinkler head.

FIGS. 5 through 9 depict a second preferred embodiment of a sprinkler head utilizing a dual axle rotation control. The sprinkler head has a housing 1 that utilizes one or more support arms 44 to support a fluid distribution control. The distribution control utilizes a distribution disk 50 mounted on an upper axle 52. The distribution disk has an apex 45 and a series of valleys and ridges 47 that serve to direct fluid sprayed onto the distribution disk. The upper axle housing is connected to a lower axle 56 positioned within a lower axle housing 58. Either or both of the upper axle housing and the lower axle housing can utilize speed control mechanisms 60, 61 to control the rotation speed of the distribution disk or the rotation speed of the upper axle housing. The sprinkler housing 62 has gear teeth that are configured to interact with a series of gear teeth positioned as an integral part of the distributor, or as a separate or integral bushing 66 having gear teeth as shown in FIG. 7. The depicted embodiment in FIG. 5 through 9 illustrate three support arms between the upper sprinkler housing and the lower sprinkler housing, although any number of support arms can be utilized without deviating from the scope of the invention disclosed herein.

Figure 9:
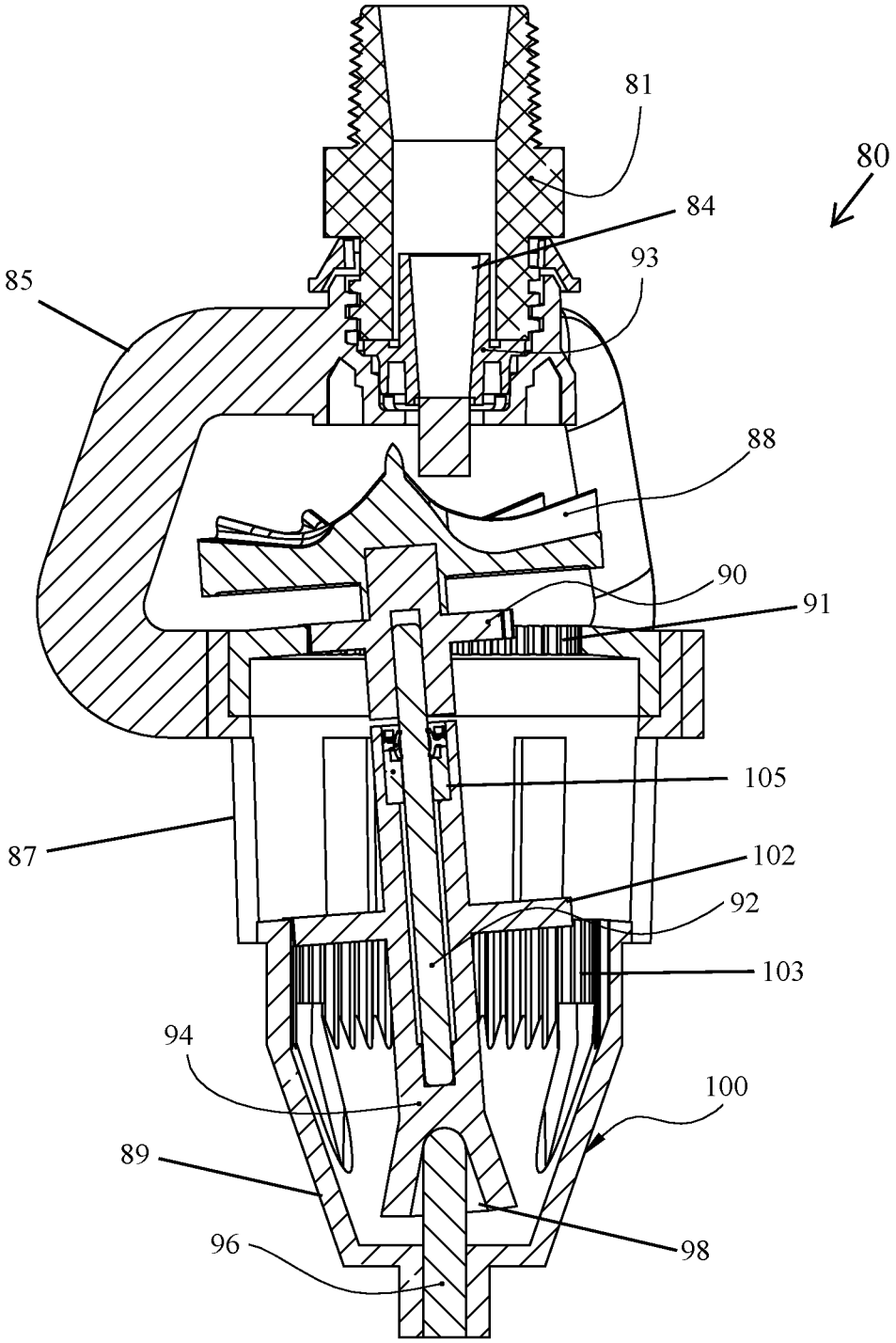
FIG. 9 is a cutaway view of a third preferred embodiment of a sprinkler head.
Figure 10:
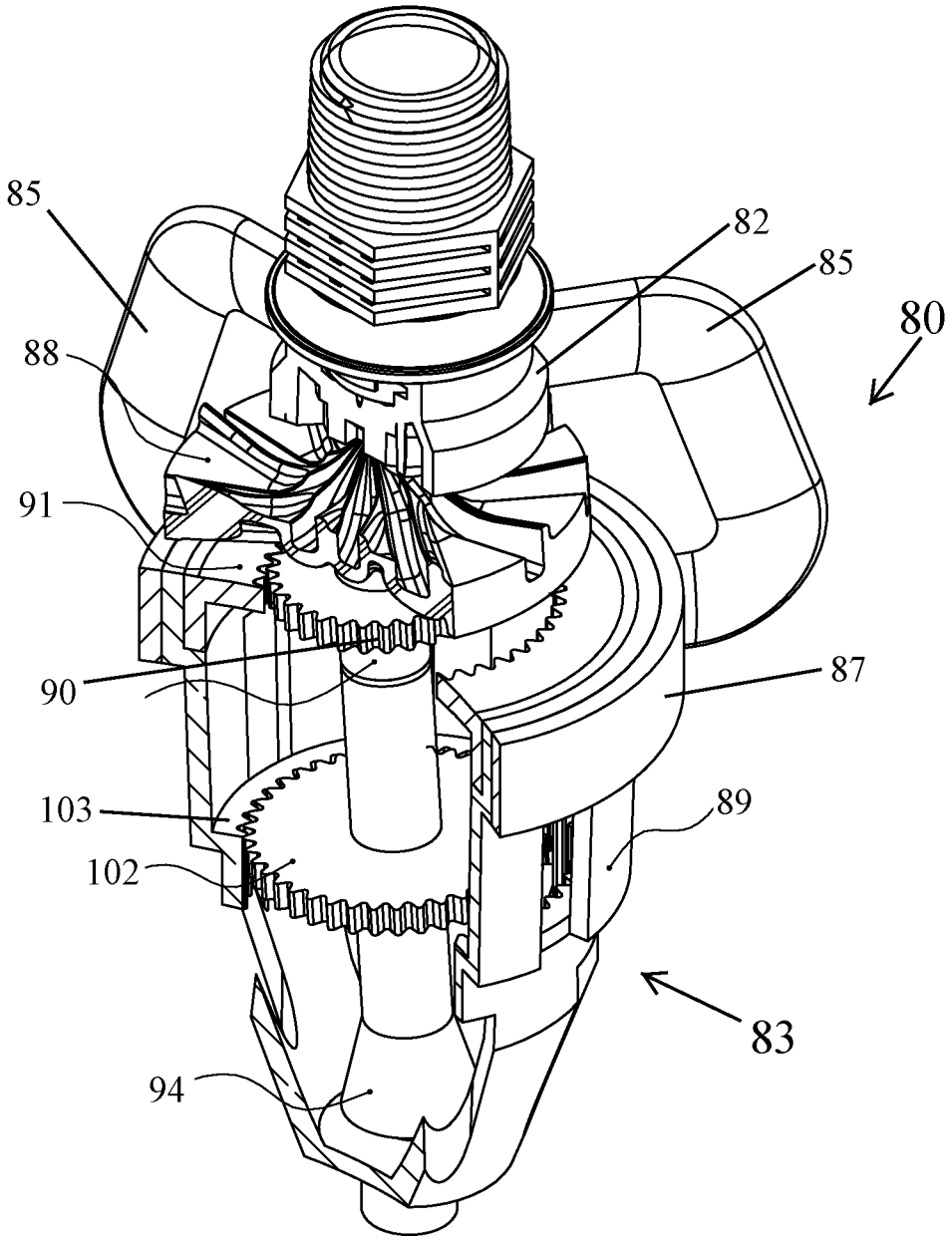
FIG. 10 is a partial cutaway perspective view of a third preferred embodiment of a sprinkler head.
Figure 11:
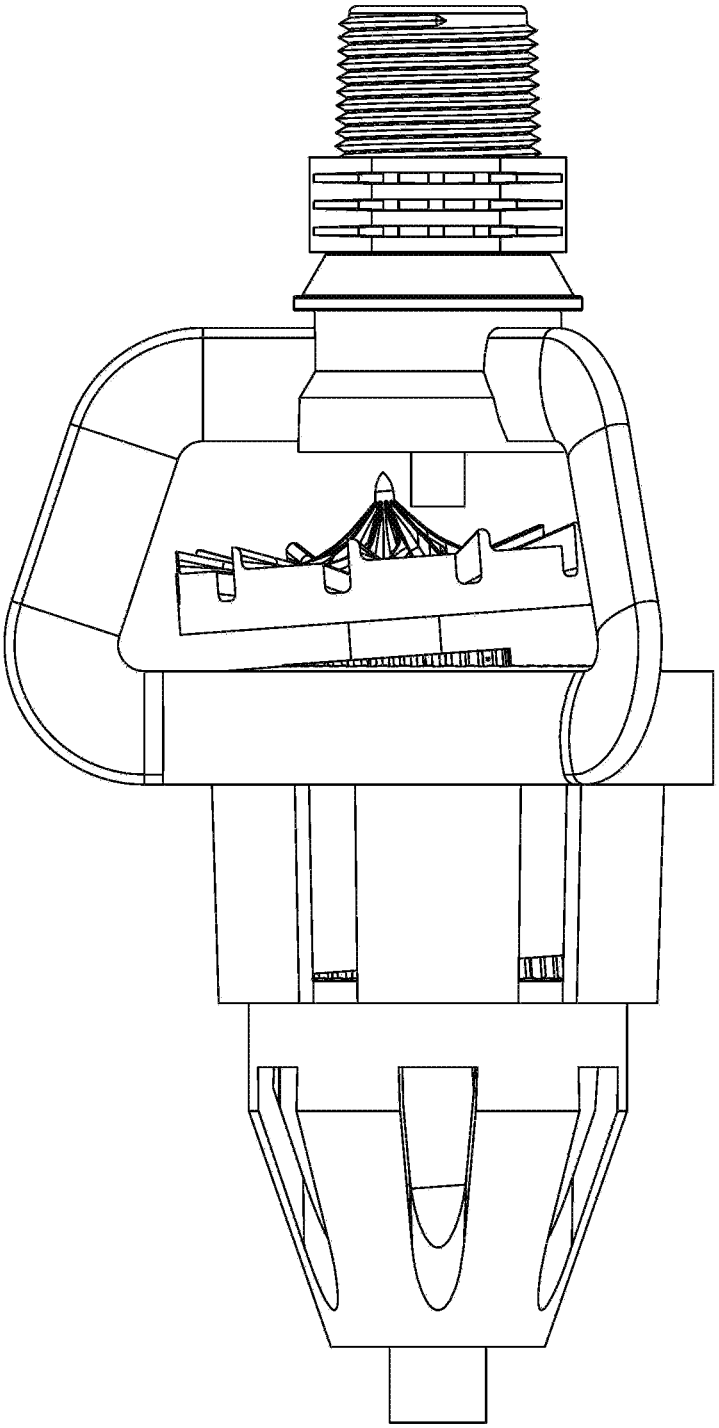
FIG. 11 is a side view of a third preferred embodiment of a sprinkler head.

FIGS. 9 through 11 illustrated a third preferred embodiment of a sprinkler head utilizing two axles to control the rotation of a fluid distribution disk. The depicted sprinkler head utilizes a nozzle 84 housed within a sprinkler body 93 that is configured to spray a stream of fluid at a distribution disk 88. The distribution disk rotates on an upper axle 102. The upper axle rotates within an axle shaft 94. In the depicted embodiment the distribution disk is connected to the upper axle via a bushing 90 that has geared teeth positioned around the circumference of the bushing.

The teeth of the bushing are configured to interact with teeth 91 positioned or formed integral with the upper gear housing 87 of the sprinkler body 100 to direct the rotation of the distribution disk. The upper axle 92 is positioned within the upper axle housing 89. The upper axle housing is configured to rotate about a lower axle 96 when fluid is sprayed onto the distribution disk from the nozzle. The upper axle housing further has a disk 102 having a series of geared teeth that are configured to engage the series of geared teeth 103 in the lower gear housing 89. The upper gear housing 87 and/or gear housing 89 make up the motor gear housing 83. The motor housing 85 is supported by one or more arms 85. The depicted configuration allows the distributor disk to spin while allowing it to rotate about the lower axle.

The upper axle housing also has a void or opening 98 configured for receiving the lower axle 98 or pin. As depicted, the upper axle housing is configured to rotate about the lower axle 96 to provide a nutation like movement to the distributor disk when fluid is sprayed on the distribution disk from the nozzle.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A sprinkler head comprising:

a sprinkler housing comprising a fluid intake, said sprinkler housing comprising an upper sprinkler body and a housing arm extending away from said upper sprinkler body, said housing arm supporting a distribution disk and distribution disk support arm, said sprinkler housing defining an annular ring configured for fluid flow through said annular ring, said annular ring defining a plurality of gear teeth;

a nozzle configured to direct said fluid from said fluid intake, said sprinkler housing defining a fluid flow path from said fluid intake through said nozzle and said annular ring onto said distribution disk;

wherein said housing arm is fixedly attached to said upper sprinkler body and supports said distribution disk from beneath said distribution disk, wherein said distribution disk support arm comprising a first end and a second end, wherein said first end is rotationally connected to said housing arm, wherein said distribution disk support arm extending from said first end to said second end, wherein said axle having a distribution disk support arm rotational axis in line with said fluid flow path such that said second end of said distribution disk support arm is configured to orbit said distribution support arm rotational;

wherein said distribution disk is rotationally connected to said distribution disk support arm at said second end at a distribution disk rotational axis on which said distribution disk spins, wherein said distribution disk rotational axis is at a tilted angle to said fluid flow path and said distribution disk support arm rotational axis;

wherein said distribution disk comprises a generally peaked surface having an apex, said surface incised by spirally radiating grooves, said distribution disk further comprising a plurality of distribution disk gear teeth positioned at a circumference of said distribution disk, wherein said distribution disk gear teeth are configured to mesh with said gear teeth of said annular ring of said annular ring.

2. The sprinkler head of claim 1, wherein said distribution disk support arm is connected to said housing arm by a lower axle, wherein said distribution disk support arm is configured to rotate on said lower axle;

wherein said distribution disk is connected to said second end of said distribution disk support arm by an upper axle, wherein said distribution disk is configured to spin on said upper axle.

3. The sprinkler head of claim 2, wherein said distribution disk support arm extends at a tilted angle from said lower axle.

4. The sprinkler head of claim 1, wherein said circumference of said distribution disk comprises a beveled surface, wherein said distributor gear teeth extend from said beveled surface.

* * * * *